US009382503B2

(12) United States Patent
Cagnina et al.

(10) Patent No.: US 9,382,503 B2
(45) Date of Patent: Jul. 5, 2016

(54) CARPET CLEANING COMPOSITION

(75) Inventors: Alessandro Cagnina, Mira (IT); Fabio Costiniti, Mira (IT); Damien Jourdan, Hull (GB); Ralf Wiedemann, Sao Paulo (BR)

(73) Assignee: Reckitt Benckiser Vanish B.V., WT Hoofddorp (NL)

( * ) Notice: Subject to any disclaimer, the term of this patent is extended or adjusted under 35 U.S.C. 154(b) by 62 days.

(21) Appl. No.: 13/984,558

(22) PCT Filed: Mar. 8, 2012

(86) PCT No.: PCT/GB2012/050511

§ 371 (c)(1),
(2), (4) Date: Nov. 11, 2013

(87) PCT Pub. No.: WO2013/120304

PCT Pub. Date: Sep. 13, 2012

(65) Prior Publication Data

US 2014/0057823 A1 Feb. 27, 2014

(30) Foreign Application Priority Data

Mar. 9, 2011 (GB) ..... 1103974.0

(51) Int. Cl.

| | |
|---|---|
| ***C11D 1/62*** | (2006.01) |
| ***C11D 1/65*** | (2006.01) |
| ***C11D 1/86*** | (2006.01) |
| ***C11D 3/00*** | (2006.01) |
| ***C11D 3/37*** | (2006.01) |
| ***C11D 3/39*** | (2006.01) |
| ***C11D 3/48*** | (2006.01) |
| ***C11D 3/22*** | (2006.01) |

(52) U.S. Cl.

CPC .. *C11D 1/62* (2013.01); *C11D 1/65* (2013.01); *C11D 1/86* (2013.01); *C11D 3/0031* (2013.01); *C11D 3/0036* (2013.01); *C11D 3/225* (2013.01); *C11D 3/37* (2013.01); *C11D 3/3715* (2013.01); *C11D 3/3719* (2013.01); *C11D 3/3723* (2013.01); *C11D 3/3765* (2013.01); *C11D 3/3776* (2013.01); *C11D 3/3942* (2013.01); *C11D 3/3947* (2013.01); *C11D 3/48* (2013.01)

(58) Field of Classification Search

USPC ..... 510/278

See application file for complete search history.

(56) References Cited

U.S. PATENT DOCUMENTS

| | | | | |
|---|---|---|---|---|
| 3,943,242 | A | 3/1976 | Fogel et al. | |
| 5,962,388 | A | 10/1999 | Sherry et al. | |
| 6,087,314 | A | 7/2000 | Heinzman et al. | |
| 2005/0019293 | A1 | 1/2005 | Suriano et al. | |
| 2006/0276363 | A1* | 12/2006 | Cagnina et al. | 510/284 |
| 2006/0293203 | A1 | 12/2006 | De Dominicis et al. | |
| 2009/0170744 | A1* | 7/2009 | Meine et al. | 510/302 |

FOREIGN PATENT DOCUMENTS

| | | | |
|---|---|---|---|
| DE | 10063434 | A1 | 7/2002 |
| EP | 0687727 | A1 | 12/1995 |
| EP | 0843002 | A2 | 5/1998 |
| EP | 0906950 | A1 | 4/1999 |
| EP | 1118656 | A1 | 7/2001 |
| WO | 9400548 | A1 | 1/1994 |
| WO | 0123511 | A1 | 4/2001 |
| WO | 02092743 | A1 | 11/2002 |

OTHER PUBLICATIONS

International Search Report for PCT/GB2012/050511 dated May 22, 2012.

Notification of Transmittal of the International Search Report and the Written Opinion of the International Searching Authority for PCT/GB2012/050511 dated May 22, 2012.

Written Opinion for PCT/GB2012/050511 dated May 22, 2012.

GB Search Report for GB1103974.0 dated Jul. 11, 2011.

* cited by examiner

*Primary Examiner* — Ling Choi

*Assistant Examiner* — Thuy-Ai Nguyen

(74) *Attorney, Agent, or Firm* — Norris McLaughlin & Marcus PA

(57) ABSTRACT

A carpet cleaning detergent comprises:

a) 0.001% to 40% w/v of a bactericidally active water-insoluble cationic compound in its salt form;

b) 0.001 to 40% w/v of an anionic surfactant;

c) 0.1 to 10 wt % bleach;

d) a resoil prevention polymer;

and e) up to 98% w/v of water.

11 Claims, No Drawings

CARPET CLEANING COMPOSITION

This is an application filed under 35 USC 371 of PCT/GB2012/050511 and which claims the priority benefit of GB 1103974.0 filed 9 Mar. 2011.

The invention relates to surfactant compositions containing a bactericide, which is a cationic compound, being specifically developed for fabric cleaning products.

In general, cationic bactericide compounds have low compatibility with anionic based surfactant compositions and they may have a negative effect in terms of the cleaning performance of the composition.

Certain cationic compounds, as described below, are well known actives able to provide good disinfecting efficacy both versus gram negative and gram positive bacteria, but have in general low compatible with anionic surfactants or anionic species in general. Cationic compounds tend to precipitate with anionic compounds or lose their bactericide efficacy due to the formation of an anionic-cationic complex that doesn't allow the cationic part of the complex to be available to kill bacteria.

The cationic compounds are, in addition, well known to cause stickiness to fabric surfaces, especially carpets, and are deleterious for soil re-deposition, which is considered an important factor for fabric care. Moreover generally cationic compounds are metal corrosives making their use in aerosols problematical.

Phenols and phenol based bactericides are other ingredients used in several application areas. However, concerns about their toxicological impact is growing, they are considered as potential carcinogens and are generally avoided for this reason.

Aldehydes such as formaldehyde and glutaraldehyde are cheap and broad-spectrum bactericides, but as with phenols, they are considered to be carcinogens or potential carcinogens and also show a tendency to sensitise people who are frequently exposed to them.

Halogens have a long history as bactericide agents. Chlorine is the active atom in household bleach and chloride and bromine are used for water disinfection. Iodine is very commonly incorporated into antiseptics, for disinfecting skin and wound dressings, and it is added to water for water treatment. Iodine used as such or in combination with organic carrier molecules, iodophors, is used as a liquid disinfectant, but it tends to stains the treated surface with reddish-brown colour.

Chlorine is cheap and very effective, but it tends to corrode metal surface and to decolourise dyes from the fabric surface.

Organic acids are known in the art to be bactericides. Examples are citric acid and salicylic acid. The organic acids are efficient at low pH, below 5 and more preferably below 4. At these low pH conditions the cleaning performances of the surfactants are reduced and the compositions work mainly as a bactericide not as a good cleaning product.

Alcohols, such as iso-propanol and ethanol, have been used for a long time in ready to use disinfectants for medical and consumer products. To be effective they need to make up a significant percentage of the composition, usually 15-70% w/v, the disadvantages are that, being a solvent, they attack many polymers and plastics and cause the composition to be high flammable.

Other known ingredients are the essential oils, such as tea tree oil, thyme oil and citronella oil. These products show a low/medium bacteria efficacy, unless used at high concentration, but at high concentrations they may become sensitisers.

According to a first aspect of the invention there is provided a carpet cleaning detergent comprising:

a) 0.001% to 40% w/v of a bactericidally active cationic compound in its salt form;
b) 0.001 to 40% w/v of an anionic surfactant;
c) 0.1 to 10 wt % bleach;
d) a (preferably cationic) resoil prevention polymer; and
e) up to 98% w/v of water.

Generally the wherein the counterion anion of the bactericidally active cationic compound has at least one of the following properties:

1) can generate a water-insoluble salt form, by water-insoluble we mean that less than 10% w/v dissolves in deionised water at 20 C., preferably less than 1% w/v;
2) has a MW of <300, (preferably less than 200) but >50 (preferably greater than 75),
3) the dissociation constant (Kd) of the salt is less than $10^{-3}$, preferably less than $10^{-6}$;

In the present invention we have surprisingly found that certain cationic compounds, as described below, are compatible with anionic surfactants and anionic based products and maintain their bactericidal activity, having a low toxicological impact and low or no negative effects on the composition in terms of cleaning, soil redeposition and fibre damage.

Whilst not wishing to be bound by theory we believe that "large" counterion anions sterically hinder complex formulation with other anionic species in the composition.

The cationic compounds of the invention are those that provide a germicidal effect to the concentrate compositions, and especially preferred are quaternary ammonium salts which may be characterised by the general structural formula:

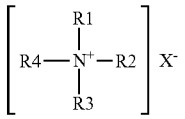

wherein R1, R2, R3 and R4 are independently selected from alkyl, aryl or alkylaryl substituent of from 1 to 26 carbon atoms, and the entire cation portion of the molecule has a molecular weight of at least 165. The alkyl substituents may be long chain alkyl, long-chain alkoxyaryl, long-chain alkylaryl, halogen-substituted long chain alkylaryl, long-chain alkylphenoxyalkyl and arylalkyl. The remaining substituents on the nitrogen atoms other than the above mentioned alkyl substituents are hydrocarbons usually containing no more than 12 carbon atoms. The substituents R1, R2, R3 and R4 may be straight-chained or may be branched, but are preferably straight-chained, and may include one or more amide, ether or ester linkages.

Preferred cationic compounds of the invention which are useful in the practice of the present invention include those which have the structural formula:

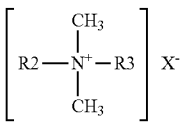

wherein R2 and R3 are each independently the same or different $C_8$-$C_{12}$ alkyl; or R2 is selected from $C_{12-16}$ alkyl, $C_{8-18}$ alkylethoxy or $C_{8-18}$ alkylphenoxyethoxy and R3 is benzyl. Counterion X is a salt forming anion as described below. The alkyl groups recited in R2 and R3 may be straight-chained or branched, but are preferably substantially linear. Such useful quaternary compounds are available and include ONYXIDETM 3300 is described as n-alkyl dimethyl benzyl ammonium saccharinate (95% active). ONYXIET™ 3300 is presently commercially available from Stepan Company, Northfield, III-USA.

Preferably the cationic compound is:

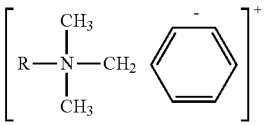

wherein R is a linear or branched alkyl chain having from 1 to 30 carbon atoms, more preferably from 10 to 16 atoms.

In the present invention the nature of the anion counterion X-is important. Preferred counterions X-are those which have at least one preferably two or all three, of the following properties: 1) can generate a water-insoluble salt form, by water-insoluble we mean that less than 10% w/v dissolves in deionised water at 20 C., preferably less than 1% w/v; 2) has a MW of <300 (preferably less than 200) but >50 (preferably greater than 75); 3) the dissociation constant (Kd) of the salt is less than 10-1, preferably less than lu-6.

A preferred feature is 2) or 2)+3).

Preferably the counterion C should have all three above properties. Preferred counterions X-of the invention are selected from saccharinate, alkyl sulfate and alkyl benzene sulfate, alkyl, sulfonate, alkyl benzene sulfonate and fatty acid.

The level of cationic compound used depends upon the product type, whether it is a ready to use product or a dilutable formula. Suitable levels for a ready to use product is 0.001% to 5% w/v, a preferred range is 0.01 to 0.5% w/v. A dilutable product requires more active and a suitable range is from 0.01 to 40% w/v, preferably between 0.5 to 20% w/v depending on the dilution ratio.

It has been surprisingly found that the cationic compound, as defined herein, is compatible with anionic surfactants as well as in general with anionic polymer based products. The compositions containing the cationic compound, anionic surfactant, non ionic surfactants, polymers, solvents, chelating agents, and other minor actives as dyes, antifoaming, perfumes, preservatives, have cleaning performance, low fabric damage, and good prevention of soil re-deposition. It has been found surprisingly that the cationic compound is very effective bactericide even in combination with anionic surfactants.

The cationic compound described in the compositions of this invention can achieve a $\log_5$ bacteria reduction at concentrations below 5000 ppm in the final liquid cleaning product, preferably below 1500 ppm. The cationic compounds described in this invention can also be mixed with low quantity of other bactericide compounds in order to increase the bactericidal efficacy without any negative effect in terms of cleaning performance. Examples of these bactericides actives are those previously described as essential oils (tea tree oil, citronella oil and thyme oil), phenols, alcohols, halogens, aldehydes and acids. The level of addition is in this case very low, between 0.001 to 1% w/v, preferably between 0.01 to 0.5% w/v.

Bleaches may be present in the composition. Examples of bleaches that may be used are oxygen bleaches.

Peroxygen bleaching actives are: perborates, peroxides (e.g. hydrogen peroxide), peroxyhydrates, persulfates. A preferred compound is sodium percarbonate and especially the coated grades that have better stability. The percarbonate can be coated with silicates, borates, waxes, sodium sulfate, sodium carbonate and surfactants solid at room temperature. For liquid compositions the bleach is preferably peroxide bleach, most preferably hydrogen peroxide. Peroxide sources other than $H_2O_2$ can be used.

Optionally, the compositions may additionally comprise from 0.01 to 30% wt, preferably from 2 to 20% wt of bleach precursors. Suitable bleach precursors are peracid precursors, i.e. compounds that upon reaction with hydrogen peroxide product peroxyacids. Examples of peracid precursors suitable for use can be found among the classes of anhydrides, amides, imides and esters such as acetyl triethyl citrate (ATC), tetra acetyl ethylene diamine (TAED), succinic or maleic anhydrides.

Examples of surfactants considered in this invention are either anionic surfactant, non-ionic surfactant and super wetting agents. Preferred levels of surfactant are from 0.01 to 40% w/v, ideally from 0.1 to 10% w/v and preferably 0.5 to 5% w/v.

The non-ionic surfactant is preferably is an amount of 0.01 to 30% w/v, ideally, 0.1 to 15% w/v or 0.5 to 10% w/v. The nonionic surfactant preferably has a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Examples of other non-ionic surfactants include higher aliphatic primary alcohols containing about twelve to about 16 carbon atoms which are condensed with about three to thirteen moles of ethylene oxide.

Other examples of non-ionic surfactants include primary alcohol ethoxylates (available under the Neodol tradename from Shell Co.), such as $C_{11}$ alkanol condensed with 9 moles of ethylene oxide (Neodol 1-9), $C_{12-13}$ alkanol condensed with 6.5 moles ethylene oxide (Neodol 23-6.5), $C_{12-13}$ alkanol with 9 moles of ethylene oxide (Neodol 23-9), $C_{12-15}$ alkanol condensed with 7 or 3 moles ethylene oxide (Neodol 25-7 or Neodol 25-3), $C_{14-15}$ alkanol condensed with 13 moles ethylene oxide (Neodol 45-13), $C_{9-11}$ linear ethoxylated alcohol, averaging 2.5 moles of ethylene oxide per mole of alcohol (Neodol 91-2.5), and the like.

Other examples of non-ionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available non-ionic detergents of the foregoing type are $C_{11-15}$ secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type non-ionic surfactants, for example, Triton X-100, as well as amine oxides can also be used as a non-ionic surfactant in the present invention.

Other examples of linear primary alcohol ethoxylates are available under the Tomadol tradename such as, for example, Tomadol 1-7, a $C_{11}$ linear primary alcohol ethoxylate with 7 moles E0; Tomadol 25-7, a $C_{12-15}$ linear primary alcohol ethoxylate with 7 moles E0; Tomadol 45-7, a $C_{14-15}$ linear primary alcohol ethoxylate with 7 moles EO; and Tomadol 91-6, a $C_{9-11}$ linear alcohol ethoxylate with 6 moles EO.

A preferred surfactant is an anionic surfactant. Such anionic surface active agents are frequently provided in a salt form, such as alkali metal salts, ammonium salts, amine salts, amino alcohol salts or magnesium salts. Contemplated as useful are one or more sulfate or sulfonate compounds including: alkyl sulfates, alkyl ether sulfates, alkylamidoether sulfates, alkyl benzene sulfates, alkyl benzene sulfonates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl carboxylates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Preferred surfactants are also alkyl naphthalene sulfonate anionic surfactants of the formula:

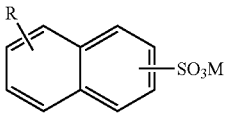

wherein R is a straight chain or branched alkyl chain having from about 1 to about 25 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation.

Particularly preferred are alkyl sarcosinate, sulfosuccinate and alkyl sulfate anionic surfactants of the formula:

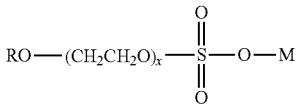

wherein R is a straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation, and x is from 0 to about 4. Most preferred are the non-ethoxylated $C_{12-15}$ primary and secondary alkyl sulfates, especially sodium lauryl sulfate.

Most desirably, the anionic surfactant according to constituent is selected to be of a type that dries to a friable powder. This facilitates their removal from carpets and carpet fibres, such as by brushing or vacuuming.

Super wetting agents are used between 0.001 to 10% w/v, preferably from 0.01 to 10% w/v, ideally from 0.1 to 5% w/v. The super wetting agents of this invention are silicone glycol copolymers.

The silicone glycol copolymers are described by the following formula:

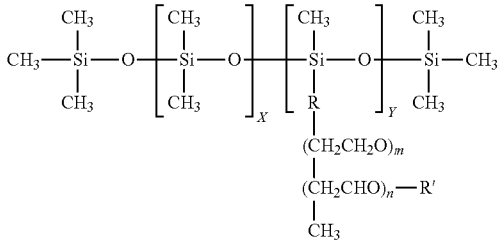

Where x, y, m and n are whole number ranging from 0 to 25. X is preferred between 0-10 and y, m and n between 0-5. R and R' are straight chain or branched alkyl chain having from about 1 to about 25 carbon atoms, saturated or unsaturated, and the longest linear portion of the alkyl chain is 15 carbon atoms or less on the average.

The super wetting agents described are able to low the surface tension in water at values below 25 mN/m, in the range between 18 and 25 mN/m at working condition concentrations of 0.0001 to 1% w/v, preferably between 0.001 to 0.1% w/v.

The composition of the present invention may also contain one or more hydrotropes.

Examples of suitable hydrotropes are sodium cumene sulfonate (ELTE-SOL SC40 available from Albright Wilson), sodium xylene sulfonate (ELTESOL SX40 available from Albright Wilson), di-sodium mono-and di-alkyl disulfonate diphenyloxide (DOWFAX 3B2 available from Dow Chemicals), n-octane sodium sulfonate (BIOTERGE PAS 7 S or 8 S available from Stepan). Levels of hydrotrope added are from 0.01% to 15% w/v.

Organic solvents may be added and may be beneficial in term of improving the solubility of the cationic compounds in water. The organic solvents should be water miscible. Preferably the organic solvent is found at levels of 0.001 to 15% w/v ideally 0.01 to 15% w/v or 0.5 to 5% w/v. The organic solvent constituent of the inventive compositions include one or more alcohols, glycols, acetates, ether acetates and glycol ethers. Exemplary alcohols useful in the compositions of the invention include $C_{2-8}$ primary and secondary alcohols which may be straight chained or branched. Exemplary alcohols include pentanol and hexanol. Exemplary glycol ethers include those glycol ethers having the general structure Ra—O—Rb—OH, wherein Ra is an alkoxy of 1 to 20 carbon atoms, or aryloxy of at least 6 carbon atoms, and Rb is an ether condensate of propylene glycol and/or ethylene glycol having from 1 to 10 glycol monomer units. Preferred are glycol ethers having 1 to 5 glycol monomer units.

By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particulaR1y useful is, propylene glycol phenyl ether, ethylene glycol hexyl ether, diethylene glycol hexyl ether.

The chelating agent is added at a level between 0.01 to 5% w/v, preferably between 0.1 to 1% w/v. Examples of chelating agents are described below:—the parent acids of the monomeric or oligomeric polycarboxylate chelating agents or mixtures therefore with their salts, e.g. citric acid or citrate/citric acid mixtures are also contemplated as useful builder components.

borate builders, as well as builders containing borate-forming materials than can produce borate under detergent storage or wash conditions can also be.

iminosuccinic acid metal salts—polyaspartic acid metal salts.

examples of bicarbonate and carbonate builders are the alkaline earth and the alkali metal carbonates, including sodium carbonate and sesqui-carbonate and mixtures thereof. Other examples of carbonate type builders are the metal carboxy glycine and metal glycine carbonate.

ethylene diamino tetra acetic acid and salt forms.

water-soluble phosphonate and phosphate builders are useful for this invention.

Examples of phosphate builders are the alkali metal tripolyphosphates, sodium potassium and ammonium pyrophosphate, sodium and potassium and ammonium pyrophosphate, sodium and potassium orthophosphate sodium polymeta/phosphate in which the degree of polymerisation ranges from 6 to 21, and salts of phytic acid.

Specific examples of water-soluble phosphate builders are the alkali metal tripolyphosphates, sodium potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

The polymers used in this invention at a level between 0.01 to 30% w/v, preferably between 0.1 to 5% w/v. Examples of polymers are: water-soluble compounds include the water soluble monomeric polycarboxylates, or their acid forms, homo or copolymeric polycarboxylic acids or their salts in which the polycarboxylic acid comprises at least two carboxylic radicals separated from each other by not more than two carbon atoms, carbonates, bicarbonates, borates, phosphates, and mixtures of any of thereof. The carboxylate or polycarboxylate builder can be monomeric or oligomeric in type although monomeric polycarboxylates are generally preferred for reasons of cost and performance. Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular. water-soluble citrates, aconitrates and citraconates as well as succinate derivates such as the carboxymethloxysuccinates described in GB-A-1,379, 241, lactoxysuccinates described in GB-A-1,389, 732, and aminosuccinates described in NL-A-7205873, and the oxypolycarboxylate materials such as 2-oxa-1,1,3-propane tricarboxylates described in GB-A-1, 387, 447.

Polycarboxylate containing four carboxy groups include oxydisuccinates disclosed in GB-A-1,261, 829. 1,1,2,2-ethane tetracarboxylates, 1,1,3,3-propane tetracarboxylates and 1,1,2,3-propane tetracarobyxlates. Polycarboxylates containing sulfo substituents include the sulfosuccinate derivatives disclosed in GB-A-1,398, 421, GB-A-1, 398, 422 and U.S. Pat. No. 3,936,448, and the sulfonate pyrolsed citrates described in GB-A-1,439, 000.

Alicylic and heterocyclic polycarboxylates include cyclopentane-cis, cis, cis-tetracarboxylates, cyclopentadienide pentacarboxylates, 2,3,4,5,6-hexane-hexacarboxylates and carboxymethyl derivates of polyhydric alcohols such as sorbitol, mannitol and xylitol. Aromatic polycarboxylates include mellitic acid, pyromellitic acid and the phthalic acid derivatives disclosed in GB-A-1,425, 343.

Of the above, the preferred polycarboxylates are hydroxycarboxylates containing up to three carboxy groups per molecule, more particulaR1y citrates.

More preferred polymers are homo-polymers, copolymers and multiple polymers of acrylic, sulfonate styrene, maleic anhydride, metacrylic, isobutylene, styrene and ester monomers.

Examples of these polymers are Acusol supplied from Rohm Haas, Syntran supplied from Interpolymer and Versa and Alcosperse series supplied from Alco Chemical, a National Starch Chemical Company.

Antifoaming agents (for non-foam executions) may be used in this invention at a level between 0.01 to 5% m/v. The foam level in fact doesn't allow to properly use the carpet cleaning machines if it is too high and in any case tends to reduce the mechanical action of the carpet cleaner machine brushes, having an impact on soil removal. Anti-foaming agents are so considered important actives of this invention.

Examples are polydimethylsiloxanes in combination with hydrophobic silica in different ratios.

Water is present in the compositions at levels of up to 98% w/v, ideally up to 90% w/v.

Up to 10% w/v, ideally 8%, 5%, 4% or 2% w/v of additional minor ingredients can be added, selected from one or more of the following; perfumes, dyes, preservatives and antifoaming agents.

Points of advantage found in this invention: the cationic compounds of the invention are compatible with anionic surfactants and other anionic species such as anionic polymers.

The cationic compounds of the invention, even if complexed provide a bactericidal action similar to uncomplexed cationic species.

The cationic compounds in fabric cleaning compositions don't cause any reduction in terms of cleaning performance, fabric damage and anti-re-deposition.

The cationic compounds can be combined with small amount of other bactericidal actives, such as essential oils, phenols, alcohols and acids, improving the bactericidal effect without lowering cleaning performance.

These cationic compounds can be used in liquid and powder carpet cleaning compositions. Examples of liquid compositions are ready to use products as triggers and dilutable products as manual and machine shampoos.

These cationic complexes are not very soluble in water, but this point can be easily overcome by combining them with anionic and non-ionic surfactants, by using solvents, hydrotropes and polymers. Heating the liquid compositions up to 60-80 C. can also help to improve the dissolution during manufacture.

A further feature of the invention is the use of a bactericidally active water-soluble cationic compound in its salt form, wherein the counterion anion has at least one of the following properties:

1) can generate a water-insoluble salt form, by water-insoluble we mean that less than 10% w/v dissolves in deionised water at 20 C., preferably less than 1% w/v;
2) has a MW of <300, preferably less than 200 but >50, preferably greater than 75;
3) the dissociation constant (Kd) of the salt is less than $10^{-3}$, preferably less than $10^{-6}$; as a bactericidally active component of a fabric treatment composition comprising from 0.001 to 40% w/v of an anionic surfactant.

Resoil Prevention Polymer/Soil Suspending Polymers

The composition may comprise from about 0.01 percent to about 10 percent, preferably from about 0.01 percent to about 4 percent, more preferably from about 0.1 percent to about 6 percent, most preferably from about 0.2 percent to about 4 percent by weight of the composition of a soil suspending polymer selected from polyesters, polycarboxylates, saccharide-based materials, modified polyethyleneimines, modified hexamethylenediamine, branched polyaminoamines, modified polyaminoamide, hydrophobic polyamine ethoxylate polymers, polyamino acids, polyvinylpyridine N-oxide, N-vinylimidazole N-vinylpyrrolidone copolymers, polyvinylpyrrolidone, polyvinyloxazolidone, polyvinylimidazole and mixtures thereof. Suitable polymers may also, generally, have a water solubility of greater than 0.3 percent at normal usage temperatures.

Polyesters

Polyesters of terephthalic and other aromatic dicarboxylic acids such as polyethylene terephthalate/polyoxyethylene terephthalate and polyethylene terephthalate/polyethylene glycol polymers, among other polyester polymers, may be utilized as the soil suspending polymer in the present composition.

High molecular weight (e.g., 40,000 to 50,000 M.W.) polyesters containing random or block ethylene terephthalate/polyethylene glycol (PEG) terephthalate units have been used as soil release compounds in laundry cleaning compositions. Sulfonated linear terephthalate ester oligomers are discussed in U.S. Pat. No. 4,968,451. Nonionic end-capped 1,2-propylene/polyoxyethylene terephthalate polyesters are discussed in U.S. Pat. No. 4,711,730 and nonionic-capped block polyester oligomeric compounds are discussed U.S. Pat. No. 4,702,857. Partly- and fully-anionic-end-capped oligomeric esters are discussed further in U.S. Pat. No. 4,721,580 and anionic, especially sulfoaroyl, end-capped terephthalate esters are discussed in U.S. Pat. Nos. 4,877,896 and 5,415,807.

U.S. Pat. No. 4,427,557, discloses low molecular weight copolyesters (M.W. 2,000 to 10,000) which can be used in aqueous dispersions to impart soil release properties to polyester fibers. The copolyesters are formed by the reaction of ethylene glycol, a PEG having an average molecular weight of 200 to 1000, an aromatic dicarboxylic acid (e.g. dimethyl terephthalate), and a sulfonated aromatic dicarboxylic acid (e.g. dimethyl 5-sulfoisophthalate). The PEG can be replaced in part with monoalkylethers of PEG such as the methyl, ethyl and butyl ethers.

Polyesters formed from: (1) ethylene glycol, 1,2-propylene glycol or a mixture thereof; (2) a polyethylene glycol (PEG) capped at one end with a C1-C 4 alkyl group; (3) a dicarboxylic acid (or its diester); and optionally (4) an alkali metal salt of a sulfonated aromatic dicarboxylic acid (or its diester), or if branched polyesters are desired, a polycarboxylic acid (or its ester). The block polyester polymers are further discussed in U.S. Pat. No. 4,702,857. Poly(vinyl ester)hydrophobe segments, including graft copolymers of poly(vinyl ester), e.g., C1-C6 vinyl esters, preferably poly(vinyl acetate), grafted onto polyalkylene oxide backbones, commercially available under the tradenames of SO-KALAN, such as SOKALAN HP-22, available from BASF, Germany may also be utilized.

U.S. Pat. No. 4,201,824, discloses hydrophilic polyurethanes having soil release and antistatic properties useful in cleaning compositions. These polyurethanes are formed from the reaction product of a base polyester with an isocyanate prepolymer (reaction product of diisocyanate and macrodiol).

EP 0752468 B1 discloses a water-soluble copolymer providing soil release properties when incorporated in a laundry cleaning composition, the copolymer comprising monomer units of poly(ethylene glycol) and/or capped poly(ethylene glycol) and monomer units of one or more aromatic dicarboxylic acids, characterized in that the copolymer comprises monomer units of poly(ethylene glycol) and/or capped poly (ethylene glycol); monomer units of one or more aromatic dicarboxylic acids wherein the aromatic is optionally sulphonated; and monomer units derived from a polyol having at least 3 hydroxyl groups.

Polycarboxylates

The present composition may comprise a polycarboxylate polymer or co-polymer comprising a carboxylic acid monomer. A water soluble carboxylic acid polymer can be prepared by polyimerizing a carboxylic acid monomer or copolymerizing two monomers, such as an unsaturated hydrophilic monomer and a hydrophilic oxyalkylated monomer. Examples of unsaturated hydrophilic monomers include acrylic acid, maleic acid, maleic anhydride, methacrylic acid, methacrylate esters and substituted methacrylate esters, vinyl acetate, vinyl alcohol, methylvinyl ether, crotonic acid, itaconic acid, vinyl acetic acid, and vinyl-sulphonate. The hydrophilic monomer may further be copolymerized with oxyalkylated monomers such as ethylene or propylene oxide. Preparation of oxyalkylated monomers is disclosed in U.S. Pat. Nos. 5,162,475 and 4,622,378. The hydrophilic oxyalkyated monomer preferably has a solubility of about 500 grams/liter, more preferably about 700 grams/liter in water. The unsaturated hydrophilic monomer may further be grafted with hydrophobic materials such as poly(alkene glycol) blocks. See, for example, materials discussed in U.S. Pat. Nos. 5,536,440, 5,147,576, 5,073,285, 5,534,183, and WO 03/054044.

Other polymeric polycarboxylates that are suitable include, for example, the polymers disclosed in U.S. Pat. No. 5,574,004. Such polymers include homopolymers and/or copolymers (composed of two or more monomers) of an alpha, beta-ethylenically unsaturated acid monomer such as acrylic acid, methacrylic acid, a diacid such as maleic acid, itaconic acid, fumaric acid, mesoconic acid, citraconic acid and the like, and a monoester of a diacid with an alkanol, e.g., having 1-8 carbon atoms, and mixtures thereof.

When the polymeric polycarboxylate is a copolymer, it can be a co-polymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which can be either relatively nonpolar such as styrene or an olefmic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide.

Copolymers of at least one unsaturated carboxylic acid monomer with at least one non-carboxylic comonomer should contain at least about 50 mol percent of polymerized carboxylic acid monomer. The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions.

Saccharide Based Materials

The present composition may comprise a soil suspension polymer derived from saccharide based materials. Saccharide based materials may be natural or synthetic and include derivatives and modified saccharides. Suitable saccharide based materials include cellulose, gums, arabinans, galactans, seeds and mixtures thereof.

Saccharide derivatives may include saccharides modified with amines, amides, amino acids, esters, ethers, urethanes, alcohols, carboxylic acids, silicones, sulphonates, sulphates, nitrates, phosphates and mixtures thereof.

Modified celluloses and cellulose derivatives, such as carboxymethylcellulose, hydroxyethylcellulose, methyl cellulose, ethyl cellulose, cellulose sulphate, cellulose acetate (see U.S. Pat. No. 4,235,735), sulphoethyl cellulose, cyanoethyl cellulose, ethyl hydroxyethylcellulose, hydroxyethyl cellulose and hydroxypropylcellulose are suitable for use in the composition. Some modified celluloses are discussed in GB 1 534 641, U.S. Pat. No. 6,579,840 B1, WO 03/040279 and WO 03/01268.

Another example of a soil suspending polymer suitable for use in the present invention includes saccharide derivatives that are polyol compounds comprising at least three hydroxy moieties, preferably more than three hydroxy moieties, most preferably six or more hydroxy moieties. At least one of the hydroxy moieties further comprising a alkoxy moiety, the alkoxy moiety is selected from the group consisting of ethoxy (E0), propoxy (PO), butoxy (BO) and mixtures thereof preferably ethoxy and propoxy moieties, more preferably ethoxy moieties. The average degree of alkoxylation is from about 1 to about 100, preferably from about 4 to about 60, more preferably from about 10 to about 40. Alkoxylation is preferably block alkoxylation.

The polyol compounds useful in the present invention further have at least one of the alkoxy moieties comprising at least one anionic capping unit. Further modifications of the compound may occur, but one anionic capping unit must be present in the compound of the present invention. One embodiment comprises more than one hydroxy moiety further comprising an alkoxy moiety having an anionic capping unit.

Suitable anionic capping unit include sulfate, sulfosuccinate, succinate, maleate, phosphate, phthalate, sulfocarboxylate, sulfodicarboxylate, propanesultone, 1,2-disulfopropanol, sulfopropylamine, sulphonate, monocarboxylate, methylene carboxylate, ethylene carboxylate, carbonates, mellitic, pyromellitic, sulfophenol, sulfocatechol, disulfocatechol, tartrate, citrate, acrylate, methacrylate, poly acrylate, poly acrylate-maleate copolymer, and mixtures thereof. Preferably the anionic capping units are sulfate, sulfosuccinate, succinate, maleate, sulfonate, methylene carboxylate and ethylene carboxylate.

Suitable polyol compounds for starting materials for use in the present invention include maltitol, sucrose, xylitol, glycerol, pentaerythitol, glucose, maltose, matotriose, maltodextrin, maltopentose, maltohexose, isomaltulose, sorbitol, poly vinyl alcohol, partially hydrolyzed polyvinylacetate, xylan reduced maltotriose, reduced maltodextrins, polyethylene glycol, polypropylene glycol, polyglycerol, diglycerol ether and mixtures thereof. Preferably the polyol compound is sorbitol, maltitol, sucrose, xylan, polyethylene glycol, polypropylene glycol and mixtures thereof. Preferably the starting materials are selected from sorbitol, maltitol, sucrose, xylan, and mixtures thereof.

Modification of the polyol compounds is dependant upon the desired formulability and performance requirements. Modification can include incorporating anionic, cationic, or zwitterionic charges to the polyol compounds. In one embodiment, at least one hydroxy moiety comprises an alkoxy moiety, wherein at least one alkoxy moiety further comprises at least one anionic capping unit. In another embodiment, at least one hydroxy moiety comprises an alkoxy moiety, wherein the alkoxy moiety further comprises more than one anionic capping unit, wherein at least one anionic capping unit, but less than all anionic capping units, is then selectively substituted by an amine capping unit. The amine capping unit is selected from a primary amine containing capping unit, a secondary amine containing capping unit, a tertiary amine containing capping unit, and mixtures thereof.

The polyol compounds useful in the present invention further have at least one of the alkoxy moieties comprising at least one amine capping unit. Further modifications of the compound may occur, but one amine capping unit must be present in the compound of the present invention. One embodiment comprises more than one hydroxy moiety further comprising an alkoxy moiety having an amine capping unit. In another embodiment, at least one of nitrogens in the amine capping unit is quatemized. As used herein "quaternized" means that the amine capping unit is given a positive charge through quatemization or protonization of the amine capping unit. For example, bis-DMAPA contains three nitrogens, only one of the nitrogens need be quatemized. However, it is preferred to have all nitrogens quaternized on any given amine capping unit.

Suitable primary amines for the primary amine containing capping unit include monoamines, diamine, triamine, polyamines, and mixtures thereof. Suitable secondary amines for the secondary amine containing capping unit include monoamines, diamine, triamine, polyamines, and mixtures thereof. Suitable tertiary amines for the tertiary amine containing capping unit include monoamines, diamine, triamine, polyamines, and mixtures thereof.

Suitable monoamines, diamines, triamines or polyamines for use in the present invention include ammonia, methyl amine, dimethylamine, ethylene diamine, dimethylaminopropylamine, bis dimethylaminopropylamine (bis DMAPA), hexemethylene diamine, benzylamine, isoquinoline, ethylamine, diethylamine, dodecylamine, tallow triethylenediamine, mono substituted monoamine, monosubstituted diamine, monosubstituted polyamine, disubstituted monoamine, disubstiuted diamine, disubstituted polyamine, trisubstituted triamine, tri substituted polyamine, multisubstituted polyamine comprising more than three substitutions provided at least one nitrogen contains a hydrogen, and mixtures thereof.

In another embodiment, at least one of nitrogens in the amine capping unit is quatemized. As used herein "quaternized" means that the amine capping unit is given a positive charge through quaternization or protonization of the amine capping unit. For example, bis-DMAPA contains three nitrogens, only one of the nitrogens need be quaternized. However, it is preferred to have all nitrogens quatemized on any given amine capping unit.

Modified Polyethyleneimine Polymer

The present composition may comprise a modified polyethyleneimine polymer. The modified polyethyleneimine polymer has a polyethyleneimine backbone having a molecular weight from about 300 to about 10000 weight average molecular weight, preferably from about 400 to about 7500 weight average molecular weight, preferably about 500 to about 1900 weight average molecular weight and preferably from about 3000 to 6000 weight average molecular weight.

The modification of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a C1-C4 alkyl, sulfates, carbonates, or mixtures thereof; (2) a substitution of one C1-C4 alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a C1-C4 alkyl or mixtures thereof; or (3) a combination thereof.

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

The modification may result in permanent quatemization of the polyethyleneimine backbone nitrogen atoms. The degree of permanent quatemization may be from 0 percent to about 30 percent of the polyethyleneimine backbone nitrogen atoms. It is preferred to have less than 30 percent of the polyethyleneimine backbone nitrogen atoms permanently quatemized. Modified polyethyleneimine polymers are also described in U.S. Pat. No. 5,565,145.

Modified Hexamethylenediamine

The present composition may comprise a modified hexamentylenediamine. The modification of the hexamentylenediamine includes: (1) one or two alkoxylation modifications per nitrogen atom of the hexamentylenediamine. The alkoxylation modification consisting of the replacement of a hydrogen atom on the nitrogen of the hexamentylenediameine by a (poly)alkoxylene chain having an average of about 1 to about 40 alkoxy moieties per modification, wherein the terminal alkoxy moiety of the alkoxylene chain is capped with hydrogen, a C1-C4 alkyl, sulfates, carbonates, or mixtures thereof; (2) a substitution of one C1-C4 alkyl moiety and one or two alkoxylation modifications per nitrogen atom of the hexamentylenediamine. The alkoxylation modification consisting of the replacement of a hydrogen atom by a (poly)alkoxylene chain having an average of about 1 to about 40 alkoxy moieties per modification wherein the terminal alkoxy moiety of the alkoxylene chain is capped with hydrogen, a C1-C4 alkyl or mixtures thereof; or (3) a combination thereof. The alkoxylation may be in the form of ethoxy, propoxy, butoxy or a mixture thereof. U.S. Pat. No. 4,597,898 Vander Meer, issued Jul. 1, 1986, Modified polyaminoamides, such as the ones discussed in U.S. Pat. No. 2005/0209125 A1, may be utilized as a soil suspending polymer. Suitable modified polyaminoamides have, depending on their degree of alkoxylation, a number average molecular weight (M n) of from 1,000 to 1,000,000, preferably from 2,000 to 1,000,000 and more preferably from 2,000 to 50,000.

Polyamino Acids

The soil suspending polymers can be derived from L-glumatic acid, D-glumatic acid or mixtures, e.g. racemates, of these L and D isomers. The polymers include not only the homopolymers of glutamic acid but also copolymers, such as block, graft or random copolymers, containing glutamic acid. These include, for example, copolymers containing at least one other amino acid, such as aspartic acid, ethylene glycol, ethylene oxide, (or an oligimer or polymer of any of these) or polyvinyl alcohol. Glutamic acid can, of course, carry one or more substituents including, for example, alkyl, hydroxy alkyl, aryl and arylalkyl, commonly with up to 18 carbon atoms per group, or polyethylene glycol attached by ester linkages. See U.S. Pat. No. 5,470,510 A, issued Nov. 28, 1995.

Polyamine N-Oxide Polymers

The polyamine N-oxide polymers suitable for use herein contain a polymerisable unit, whereto an N-oxide group can be attached to or wherein the N-oxide group forms part of the polymerisable unit or a combination of both. Suitable polyamine N-oxides wherein the N-oxide group forms part of the polymerisable unit comprise polyamine N-oxides wherein the N-oxide group comprises part of a heterocyclic group such as pyridine, pyrrole, imidazole, pyrrolidine, piperidine, quinoline, acridine and derivatives thereof. Another class of said polyamine N-oxides comprises the group of polyamine N-oxides wherein the N-Oxide group is attached to the polymerisable unit. Preferred class of these polyamine N-oxides are the polyamine N-oxides.

Any polymer backbone can be used as long as the amine oxide polymer formed has dye transfer inhibiting properties. Examples of suitable polymeric backbones are polyvinyls, polyalkylenes, polyesters, polyethers, polyamide, polyimides, polyacrylates and mixtures thereof. The amine N-oxide polymers of the present invention typically have a ratio of amine to the amine N-oxide of about 10:1 to about 1:1000000. However the amount of amine oxide groups present in the polyamine oxide polymer can be varied by appropriate copolymerization or by appropriate degree of N-oxidation. Preferably, the ratio of amine to amine N-oxide is from about 2:3 to about 1:1000000; from about 1:4 to about 1:1000000; and from about 1:7 to about 1:1000000. The soil suspending polymers encompass random or block copolymers where one monomer type is an amine N-oxide and the other monomer type is either an amine N-oxide or not. The amine oxide unit of the polyamine N-oxides has a pKa less than 10, pKa less than 7, and pKa less than 6. The polyamine oxides can be obtained in almost any degree of polymerization. The degree of polymerization is not critical provided the material has the desired soil-suspending power. Typically, the average molecular weight is within the range of about 500 to about 1000,000; from about 1,000 to about 50,000, from about 2,000 to about 30,000, and from about 3,000 to about 20,000.

N-Vinylimidazole N-Vinylpyrrolidone Copolymers

Suitable soil suspending polymers for use in the cleaning compositions are selected from N-vinylimidazole N-vinylpyrrolidone copolymers wherein a molar ratio of N-vinylimidazole to N-vinylpyrrolidone from about 1 to about 0.2, from about 0.8 to about 0.3, and from about 0.6 to about 0.4 and said polymer has an average molecular weight range from about 5,000 to about 50,000; from about 8,000 to about 30,000; and from about 10,000 to about 20,000. The average molecular weight range was determined by light scattering as described in Barth H. G. and Mays J. W. Chemical Analysis Vol 113,"Modem Methods of Polymer Characterization".

Polyvinylpyrrolidone

Another suitable soil suspending polymer for use herein comprise a polymer selected from polyvinylpyrrolidone ("PVP") having an average molecular weight from about 2,500 to about 400,000 can also be utilized; from about 5,000 to about 200,000; from about 5,000 to about 50,000; and from about 5,000 to about 15,000 can also be utilized. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696).

Polyvinyloxazolidone and Polyvinylimidazole

Other suitable soil suspending polymers for use herein include polyvinyloxazolidone having an average molecular weight from about 2,500 to about 400,000 and polyvinylimidazole having an average molecular weight from about 2,500 to about 400,000.

EXAMPLES

| Raw Material | FOAM A | FOAM B | FOAM C |
|---|---|---|---|
| Na N-Lauroyl Sarcosinate, 30% | 1.0000 | 1.0000 | 2.0000 |
| ALCOHOL ETHOXYLATE C12-C15, 8EO | 0.2600 | 0.2600 | 0.5000 |
| Dipropylene glycol n-propyl ether | 5.0000 | 5.0000 | 5.0000 |
| MGDA 40% | 4.0000 | 4.0000 | 4.0000 |
| AMMONIUM HYDROXIDE 33% | 0.0450 | 0.2000 | 0.2000 |
| Sodium BENZOATE | | 0.2000 | 0.2000 |
| SODIUM SILICATE 36% | 0.3000 | 0.3000 | 0.3000 |
| Benzylkonium Chloride 50% | 0.2150 | 0.4000 | 0.6000 |
| Benzalkonium Saccarinate 33% | 1.0000 | 0.6000 | |
| AEROSOL PROPELLANT | 6.0000 | 4.5000 | 4.5000 |
| Deionised Water | 82.1800 | 83.5400 | 82.7000 |
| | 100.000 | 100.000 | 100.000 |

| Raw Material | SHAMPOO A |
|---|---|
| alkyl dimethyl hydroxy ethyl ammonium chloride | 2.000 |
| Alcohol Ethoxylate, 5EO | 0.500 |
| 1-Hydroxyethylidene (1,1-diphosphonic acid) | 0.120 |
| Hydrogen peroxide | 3.000 |
| Acrylic Polymer | 0.750 |
| Fragrance | 0.100 |
| Quaternary ammonium compounds, benzyl-C12-16-alkyldimethyl, chlorides | 2.000 |
| Sodium Hydroxyde | 0.036 |
| Deionised Water | 91.4940 |
| | 100.000 |

The invention claimed is:

1. A carpet cleaning composition having an acidic pH which comprises:

bactericidally active cationic compounds comprising 0.001% to 20% w/v of a benzyl $C_{12}$-$C_{16}$ alkyl dimethyl quaternary ammonium cationic compound in its chloride salt form and 0.001% to 20% w/v of an alkyl dimethyl hydroxyl ethyl ammonium chloride;

0.1 to 10 wt % bleach;

a resoil prevention polymer which is a selected from homo polymer or copolymer, which includes one or more monomers selected from acrylic, sulfonate styrene, maleic anhydride, methacrylic, isobutylene, styrene and ester monomers;

in excess of 80% and up to 98% w/v of water;

wherein each of the bactericidally active cationic compounds meets at least one condition selected from the group consisting of :

(a) in its salt form it has an aqueous solubility of less than 10% w/v in deionized water at 20° C.;

(a-1) in its salt form it has an aqueous solubility of less than 1% w/v in deionized water at 20° C.;

(b) it has a MW of greater than 50 and less than 300 ;

(b-1) it has a MW of less than 200;

(b-2) it has a MW of great than 75;

(c-1) the disassociation constant of its salt form is less than $10^{-3}$;

(c-2) the disassociation constant of its salt form is less than $10^{-6}$.

2. A carpet cleaning composition according to claim 1, which additionally comprises 0.001 to 30% w/v of a non-ionic surfactant.

3. A carpet cleaning composition according to claim 1, which additionally comprises 0.001 to 10% w/v of a super-wetting agent.

4. A carpet cleaning composition according to claim 3 wherein the super wetting agent is able to lower the surface tension of water to below 25 mN/m at concentrations of 0.0001 to 1% w/v.

5. A carpet cleaning composition according to claim 1 which additionally comprises 0.01-5% w/v of a chelating agent, and up to 2% w/v of minor ingredients selected from perfumes, dyes, preservatives and antifoaming agents.

6. A carpet cleaning composition according to claim 1 which additionally comprises from 0.001 to 1% w/v of an additional bactericidally active product selected from essential oils , phenols, alcohols, halogens, aldehydes and acids.

7. A carpet cleaning composition according to claim 1, wherein each bactericidally active cationic compound meets at least two conditions selected from the group consisting of: (a), (a-1), (b), (b-1), (b-2), (c-1) and (c-2).

8. A carpet cleaning composition according to claim 7, each bactericidally active cationic compound meets at least three conditions selected from the group consisting of (a), (a-1), (b), (b-1), (b-2), (c-1) and (c-2).

9. A carpet cleaning composition according to claim 1, wherein the soil prevention polymer is an acrylic polymer.

10. A carpet cleaning composition according to claim 1, which contains at least about 82% w/v of water.

11. A carpet cleaning composition according to claim 10, which contains at least about 91% w/v of water.

* * * * *